US006426735B1

(12) United States Patent
Henzen

(10) Patent No.: US 6,426,735 B1
(45) Date of Patent: Jul. 30, 2002

(54) LIQUID CRYSTAL DISPLAY DEVICE

(75) Inventor: Alexander V. Henzen, Heerlen (NL)

(73) Assignee: U.S. Philips Corporation, New York, NY (US)

( * ) Notice: Subject to any disclaimer, the term of this patent is extended or adjusted under 35 U.S.C. 154(b) by 500 days.

(21) Appl. No.: 08/762,687

(22) Filed: Dec. 11, 1996

(30) Foreign Application Priority Data

Dec. 15, 1995 (EP) ..... 95203503

(51) Int. Cl.[7] ..... G09G 3/36
(52) U.S. Cl. ..... 345/101; 345/90
(58) Field of Search ..... 345/101, 87, 33, 345/50, 90, 51, 53; 349/36, 33

(56) References Cited

U.S. PATENT DOCUMENTS

| | | | | |
|---|---|---|---|---|
| 4,045,791 A | 8/1977 | Fukai et al. | ..... | 340/324 |
| 4,298,866 A | 11/1981 | Hodemaekers | ..... | 340/713 |
| 4,902,107 A | 2/1990 | Tsuboyama et al. | ..... | 350/350 |

*Primary Examiner*—Dennis-Doon Chow

(57) ABSTRACT

Liquid crystal display device (1) (particularly having a low threshold voltage) provided with means (9, 13, 20, 21) for compensating the temperature dependence of characteristic voltages of the display device by adapting the frequency at which the pixels are driven. The voltages to be used then do not need to be adapted, notably if they are determined once for the highest occurring drive frequency (which generally occurs at the highest operating temperature).

6 Claims, 2 Drawing Sheets

| | |
|---|---|
| a | 130.00 – 135.00 |
| b | 125.00 – 130.00 |
| c | 120.00 – 125.00 |
| d | 115.00 – 120.00 |
| e | 110.00 – 115.00 |
| f | 105.00 – 110.00 |
| g | 100.00 – 105.00 |
| h | 95.00 – 100.00 |

LIQUID CRYSTAL DISPLAY DEVICE

BACKGROUND OF THE INVENTION

The invention relates to a liquid crystal display device comprising a first substrate which is provided with electrodes, and a second substrate which is parallel to the first substrate and is provided with electrodes, and a twisted nematic liquid crystal material having a positive dielectric anisotropy between the two substrates, while, viewed perpendicularly to the substrates, overlapping parts of the electrodes define pixels, the display device being further provided with drive means for presenting voltages to the electrodes.

Display devices of this type are generally known and are used, for example in display screens for alphanumerical display devices in, for example, computer apparatus and measuring apparatus, but also in car radios and telephone apparatus.

The use of such display devices may give rise to problems at a varying ambient temperature, because values which are characteristic of the liquid crystal, such as threshold voltage and saturation voltage, are dependent on temperature. To be able to use these display devices in a large temperature range, the drive voltages are usually adapted in dependence upon the temperature, as described, for example, in U.S. Pat. No. 4,298,866. However, this means that the drive voltages are chosen from a fairly large voltage range, which requires a high power supply voltage for the drive electronics. Notably in portable apparatus, as in said measuring and telephone apparatus which are usually battery-powered, this may give rise to problems.

This problem may be partly solved by choosing a liquid crystal material having a low threshold voltage and thus a lower operating voltage. Such low threshold voltages (and hence the other characteristic voltages of the display elements) have the additional advantage that a higher multiplex ratio can be achieved in the multiplex drive mode.

A drawback is that the threshold voltage is related to the dielectric constant of the liquid crystal material parallel to the liquid crystal molecules ($\in_{\parallel}$). When the threshold voltage decreases, $\in_{\parallel}$ increases.

Said dielectric constant is frequency-dependent, which means in practice that, above a given threshold frequency, this dielectric constant decreases due to relaxation so that the threshold voltage of the liquid crystal material effectively increases above this threshold frequency. To be able to realize the desired low threshold voltage, the drive frequency is therefore chosen in practice as low as possible. On the other hand, a pixel must be driven at a sufficiently high frequency so as to prevent flicker (the repetition time should be several times (about a factor of 5) smaller than the response time of the liquid crystal material.

OBJECTS AND SUMMARY OF THE INVENTION

It is an object of the invention to substantially obviate one or more of the above-mentioned problems. It is another object of the invention to provide a display device, notably based on the STN effect (twist angles between 160° and 360°) having a high multiplex degree through a wide range of temperatures.

To this end, a liquid crystal display device according to the invention is characterized in that the drive means are provided with means for controlling the frequency at which pixels are driven, dependent on the temperature of the display device.

The invention is based on the recognition that, notably upon a decrease of temperature, the threshold voltage (and hence the other characteristic voltages of the display elements) strongly increase with the frequency, while much lower drive frequencies can be used at these lower temperatures. This particularly applies to said liquid crystal materials having a low threshold voltage ($V_{th}$<2 Volts~, particularly<1,8 Volts). The relevant frequency control does not necessarily have to work for a full range of temperatures but may be limited to, for example, a range of temperatures below 20° C.

A preferred embodiment of a display device is characterized in that the drive means comprise means for decreasing the frequency at which pixels are driven when the temperature decreases, and for increasing the frequency when the temperature increases. The frequency adaptation is not necessarily continuous but may be performed in steps. In that case, the drive means are provided, for example, with an oscillator and a plurality of frequency dividers which adjust the frequency in dependence on the temperature value supplied by a temperature sensor.

A further preferred embodiment is characterized in that the drive means are provided with means for increasing the duration of row selection times when the frequency at which the rows are selected is decreased, and for decreasing the duration of row selection times when the frequency at which the rows are selected is increased. Notably in the RMS drive mode, it is then achieved that the effective voltage across the pixels can be applied at lower data and selection voltages.

These and other aspects of the invention will be apparent from and elucidated with reference to the embodiments described hereinafter.

BRIEF DESCRIPTION OF THE DRAWINGS

In the drawings:

FIG. 2 shows the dependence of the temperature and the frequency on the value $V_{50}$, while

The Figures are diagrammatic and not to scale. Corresponding elements are generally denoted by the same reference numerals.

DESCRIPTION OF THE PREFERRED EMBODIMENTS

Figure 1:
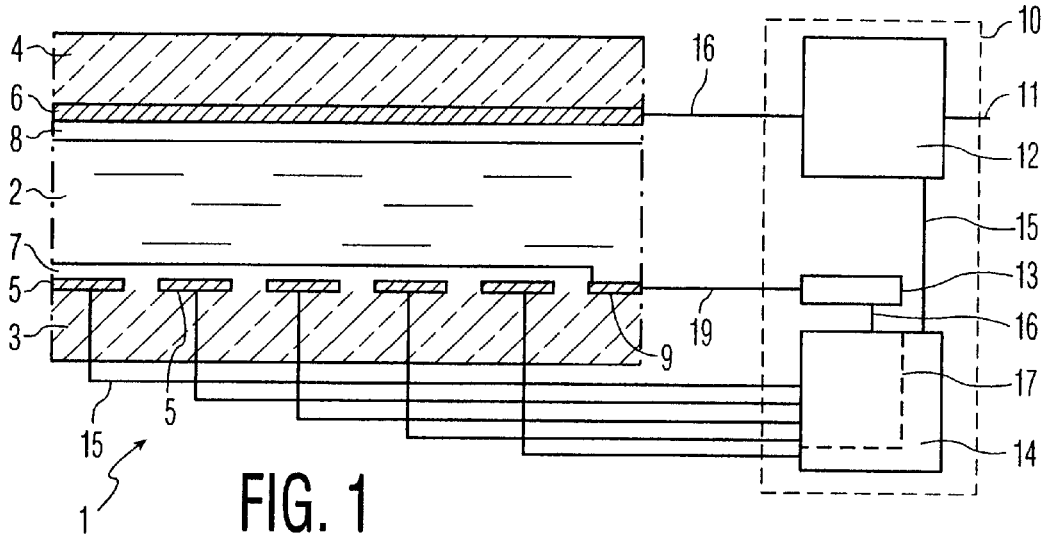
FIG. 1 is a diagrammatic cross-section of a part of the display device, together with a diagrammatic representation of the drive section.

FIG. 1 is a diagrammatic cross-section of a part of a liquid crystal display device comprising a liquid crystal cell 1 with a twisted nematic liquid crystal material 2 which is present between two supporting plates or substrates 3 and 4 of, for example, glass or quartz, provided with selection electrodes 5 and data electrodes 6, respectively, in this embodiment. In this case, the liquid crystal material (for example, MLC 3700 of the firm of Merck) has a positive optical anisotropy and a positive dielectric anisotropy and a low threshold voltage. If necessary, the device comprises polarizers (not shown) whose polarization directions are, for example, mutually crossed perpendicularly. The device further comprises orientation layers 7, 8 which orient the liquid crystal material on the inner walls of the substrates in such a way that the twist angle is, for example, 240°. The picture display device is of the passive type, but it may also be provided with active switching elements which connect picture electrodes to drive electrodes. The cell also comprises a temperature sensor 9 shown diagrammatically, for example, a temperature-sensitive resistor which is connected via signal lines 19 to a part 13 of the drive section 10 denoted by means of broken lines.

Incoming information 11 is processed if necessary, in the drive section 10 and stored in a data register 12 and presented to the data electrodes 6 via data signal lines 16. Pixels, here arranged in rows and columns, are selected by successively selecting row electrodes 5 which are connected to a multiplex circuit 14 via row signal lines 15. The mutual synchronization between the multiplex circuit 14 and the data register 12 is ensured by the line 15. After all rows electrodes have been selected, this selection is repeated; this is effected at the frame frequency.

Figure 2:
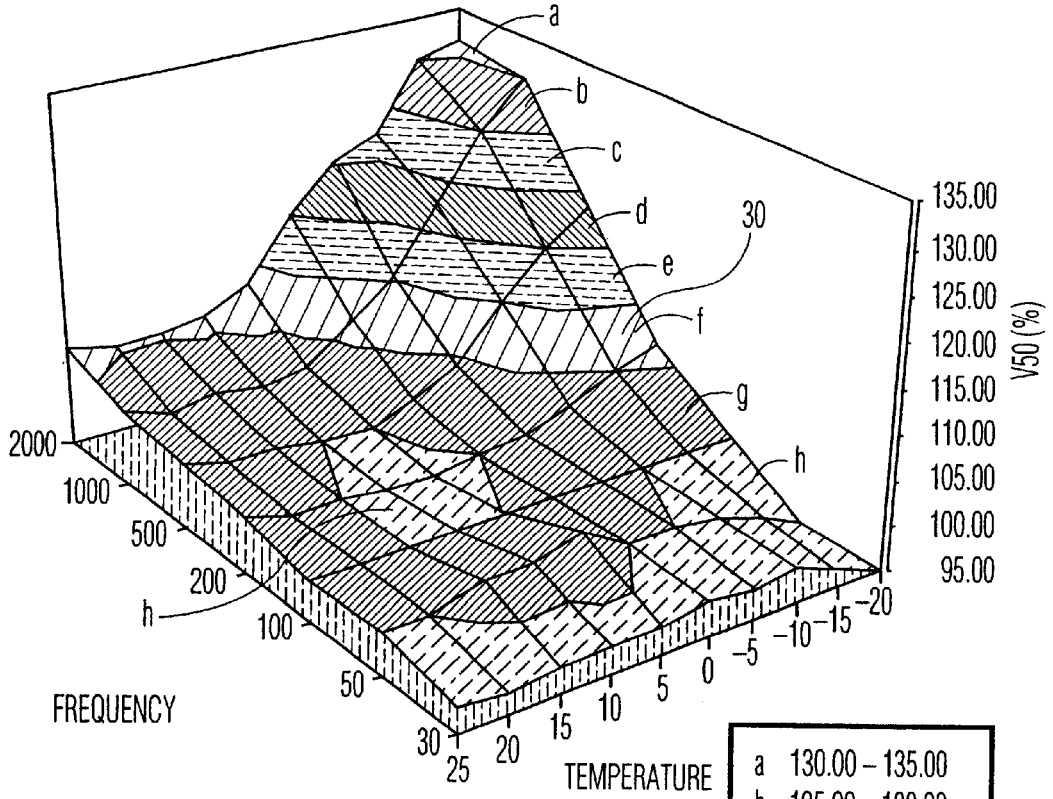

FIG. 2 shows values of the deviation of $V_{50}$ as a function of temperature and frequency for the device of FIG. 1 with respect to the value at 25° C. and 100 Hz. Here, $V_{50}$ is the voltage value at which the transmission is 50% of the maximum transmission; this value is directly coupled to other characteristic values such as the threshold voltage or the saturation voltage in the transmission/voltage characteristic of the display device. In an example with a multiplex ratio of 1:32 (i.e. 32 selection lines) and a frame frequency of 70 Hz, the repetition frequency at a pixel is 32*70 Hz=2240 Hz, or at the more conventional drive with DC compensation, it is half this value, namely 1120 Hz.

FIG. 2 shows that this is near the region 30, in which $V_{50}$ deviates by more than 5% from the value at 25° C. and 100 Hz. FIG. 2 also shows that the increase of $V_{50}$ is unacceptable at lower temperatures (at said 1120 Hz). To ensure a satisfactory operation at lower temperatures (notably at −20° C.) (i.e. $V_{50}$ deviates by less than 5% from the value at 25° C. and 100 Hz), the repetition frequency at a pixel should be lower than approximately 150 Hz, which corresponds to a frame frequency of approximately 9.4 Hz. Due to flicker, the latter value is unacceptable at room temperature but is quite suitable at lower temperature. At lower temperatures, the liquid crystal liquid is more viscous so that a pixel will switch more slowly, and also in this case the repetition time is much shorter than the response time of the liquid crystal material so that, also at this low temperature, there is no flicker.

Figure 3:
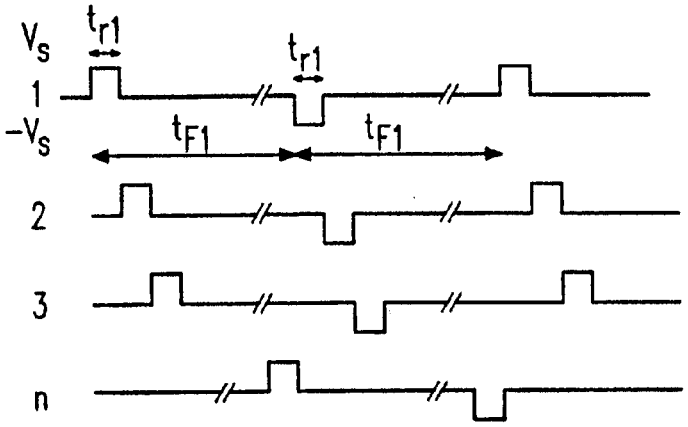
FIGS. 3 to 5 show diagrammatically a plurality of drive pulses.
Figure 4:
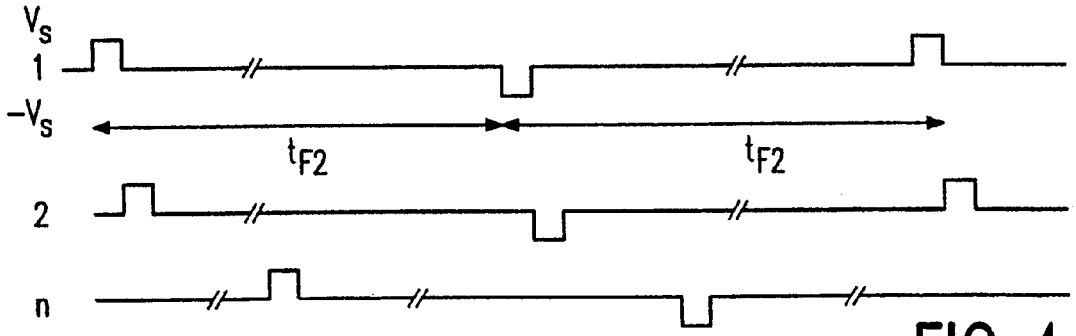
Figure 5:
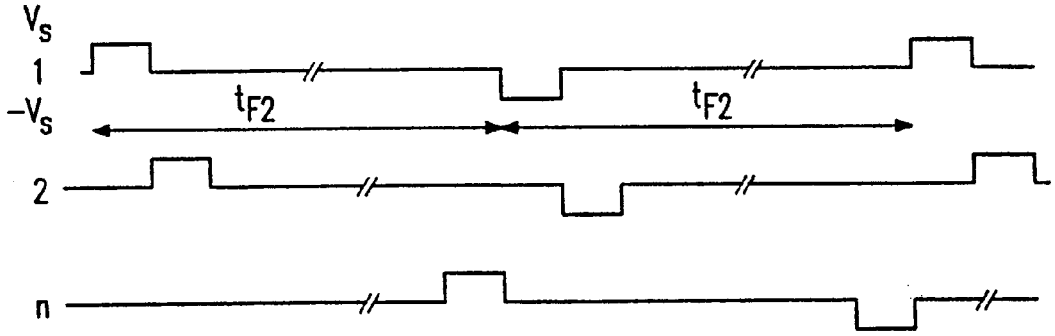

FIGS. 3 to 5 show row selection signals at room temperature (FIG. 3) and a lower temperature (for example, 0° C. or lower), respectively, for a passive display device using 1:n multiplexing. The rows 1, 2, 3 . . . , n are successively selected by means of row selection pulses having a pulse width $t_{r1}$ and a voltage $V_5$. The frame time $t_{F1}$ is thus $n.t_{r1}$ (at 25° C. and 100 Hz); in a subsequent frame time, the pixels are driven with inverted data and row signals. The frequency of the signal at the pixel is thus $1/(2.t_{F1})$. As described above, it is sufficient to use a lower frequency at lower temperatures, in this example $1/(2.t^{F2})$. The same pulse patterns as in FIG. 3 may be chosen for the row selection pulses in this case, while no row is selected during a period $(t_{F2}-t_{F1})$. Since the RMS voltage is decisive for driving, which voltage is also influenced by the duration of the row selection pulses, such a pulse width $t_{r2}$ is preferably chosen for the row selection pulses that the frame time $t_{F2}$ is about $n.t_{r2}$. Due to the longer row selection times, the selection voltages do not need to be changed or hardly need to be changed with respect to those at 25° C. and 100 Hz. At large temperature fluctuations (for example, over 25° C.) a small adaptation of the selection voltage may be necessary, because other values determining the threshold voltage may also be temperature-dependent (for example, the visco-elastic constant).

Figure 6:
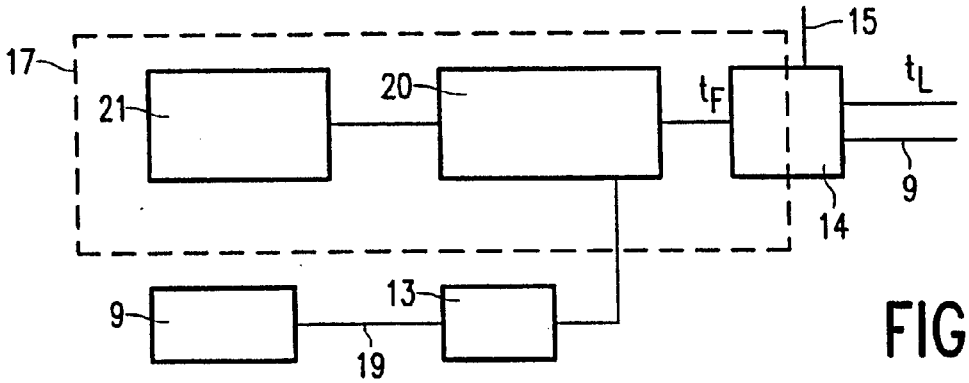
FIG. 6 shows the realization of a part of the drive section of FIG. 1.

FIG. 6 shows diagrammatically the structure of a part 17 of the drive section 10. The signal line 19 connected to the temperature sensor 9 is connected via an A/D converter 13 or directly to a frequency selection circuit or frequency divider 20. Dependent on the measured temperature, which may also be measured elsewhere, for example, outside the actual display (or whose value is directly introduced), the frequency from a main oscillator 21 is divided in such a way that the multiplex circuit 14 applies row signals to the row electrodes 5 with row selection pulses of the optimum pulse width $t_{r2}$ at the relevant temperature, at a frame time $t_{F2}$. Simultaneously, the data register 12 is controlled via the line 18 in such a way that data signals are (synchronously) presented to the data electrodes, also at pulse width $t_{r2}$.

In summary, the invention relates to a liquid crystal display device (particularly having a low threshold voltage) provided with means for compensating the temperature dependence of characteristic voltages of the display device by adapting the frequency at which pixels are driven. The voltages to be used then do not need to be adapted or hardly need to be adapted, notably, if they are determined once for the highest occurring drive frequency (which generally occurs at the highest operating temperature).

The invention is not only applicable to the display devices having a passive or active drive as described above, but other addressing methods are alternatively possible, for example, plasma addressing or optical addressing, at which the addressing frequency can be varied.

What is claimed is:

1. A liquid crystal display device comprising a first substrate which is provided with electrodes, and a second substrate which is parallel to the first substrate and is provided with electrodes, and a twisted nematic liquid crystal material having a positive dielectric anisotropy between the two substrates, while, viewed perpendicularly to the substrates, overlapping parts of the electrodes define pixels, the display device being further provided with drive means for presenting voltages to the electrodes, characterized in that the drive means are provided with means for controlling the frequency at which pixels are driven, dependent on the temperature of the display device.

2. A liquid crystal display device as claimed in claim 1, characterized in that the drive means comprise means for decreasing the frequency at which pixels are driven when the temperature decreases, and for increasing said frequency when the temperature increases.

3. A liquid crystal display device as claimed in claim 1, characterized in that the pixels are divided into rows and columns and the drive means are provided with means for decreasing the frequency at which the rows are selected when the temperature decreases, and for increasing said frequency when the temperature increases.

4. A liquid crystal display device as claimed in claim 3, characterized in that the pixels are defined by overlapping portions of column and row electrodes.

5. A liquid crystal display device as claimed in claim 3, characterized in that the drive means are provided with means for increasing the duration of row selection times when the frequency at which the rows are selected is decreased, and for decreasing the duration of row selection times when the frequency at which the rows are selected is increased.

6. A liquid crystal display device as claimed in claim 2, characterized in that the drive means are provided with an oscillator and at least a frequency divider which adjust the frequency in dependence upon the temperature value supplied by a temperature sensor.

* * * * *